US009327250B2

(12) United States Patent
Maryamchik et al.

(10) Patent No.: US 9,327,250 B2
(45) Date of Patent: May 3, 2016

(54) FLUIDIZING NOZZLE OR BUBBLE CAP ASSEMBLY FOR AIR DISTRIBUTION GRID

(71) Applicant: Babcock & Wilcox Power Generation Group, Inc., Barberton, OH (US)

(72) Inventors: Mikhail Maryamchik, Fairlawn, OH (US); Michael J Szmania, Medina, OH (US); Stephen W Borsani, Wadsworth, OH (US); William C Henson, Massillon, OH (US); Donald L Wietzke, Carlsbad, CA (US); Joseph C Comanitz, Canton, OH (US)

(73) Assignee: The Babcock & Wilcox Company, Barberton, OH (US)

( * ) Notice: Subject to any disclaimer, the term of this patent is extended or adjusted under 35 U.S.C. 154(b) by 38 days.

(21) Appl. No.: 14/272,113

(22) Filed: May 7, 2014

(65) Prior Publication Data

US 2015/0321153 A1 Nov. 12, 2015

(51) Int. Cl.
*B01F 3/04* (2006.01)

(52) U.S. Cl.
CPC ..... *B01F 3/0412* (2013.01)

(58) Field of Classification Search
CPC ..... B01D 3/18; B01D 3/205; B01J 8/44; F23C 10/20; F28D 13/00; B01F 3/0412
USPC ..... 261/114.2
See application file for complete search history.

(56) References Cited

U.S. PATENT DOCUMENTS 973,795 A * 10/1910 Lummus ..... B01F 3/04801 261/108
1,691,609 A * 11/1928 Oskrit ..... F16L 41/086 285/136.1
2,084,726 A * 6/1937 Duey ..... B01D 3/205 261/114.2
2,398,953 A * 4/1946 O'Brien ..... B01D 3/205 261/114.2
2,445,083 A * 7/1948 Reed ..... B01D 3/205 261/114.2
2,480,862 A * 9/1949 Johnson ..... B01D 3/205 261/114.1
2,510,556 A * 6/1950 Collins ..... B01D 3/205 261/114.2
2,540,781 A * 2/1951 Glitsch ..... B01D 3/18 24/459
2,547,383 A * 4/1951 Glitsch ..... B01D 3/205 261/114.1

(Continued)

FOREIGN PATENT DOCUMENTS

FR 2 542 628 * 10/1984
GB 2 157 588 A * 10/1985
WO WO 02/13959 A1 * 2/2002

*Primary Examiner* — Charles Bushey
(74) *Attorney, Agent, or Firm* — Eric Marich

(57) ABSTRACT

A bubble cap assembly for an air distribution grid includes a stem having a top region and a bottom region, a bubble cap connected to the top region of the stem, a membrane having an opening, the bottom region of the stem communicating with the opening; a flange connected to the bottom region of the stem; at least one clamp for pressing the flange against the membrane, and a gasket squeezed between the flange and the membrane by the clamp to provide an air-tight connection between the flange and the membrane.

8 Claims, 9 Drawing Sheets

(56) References Cited

U.S. PATENT DOCUMENTS 2,580,260 A * 12/1951 Winters ..... B01D 3/205 220/243
2,602,652 A * 7/1952 Haynes ..... B01D 3/205 261/114.2
2,612,360 A * 9/1952 Haynes ..... B01D 3/205 261/114.2
2,645,468 A * 7/1953 Sullivan ..... B01D 3/205 261/114.2
2,710,177 A * 6/1955 Young ..... B01D 3/163 261/114.2
2,732,194 A * 1/1956 Jackson ..... B01D 3/205 261/114.2
3,896,996 A * 7/1975 Roest ..... B01F 5/0413 239/424
4,146,950 A * 4/1979 Powers ..... B01D 3/205 228/170
4,305,895 A * 12/1981 Heath ..... B01D 3/205 202/158
4,346,054 A * 8/1982 Lofgren ..... F28D 13/00 110/245
4,418,650 A * 12/1983 Johnson ..... B01J 8/1836 110/245
5,045,247 A * 9/1991 Treese ..... B01F 3/04241 261/114.2
5,158,714 A * 10/1992 Shih ..... B01D 3/008 261/114.2
6,868,795 B2 * 3/2005 Maryamchik ..... F23C 10/20 110/245
8,114,359 B2 * 2/2012 Maryamchik ..... B01D 53/56 239/132

* cited by examiner

FIG. 5A
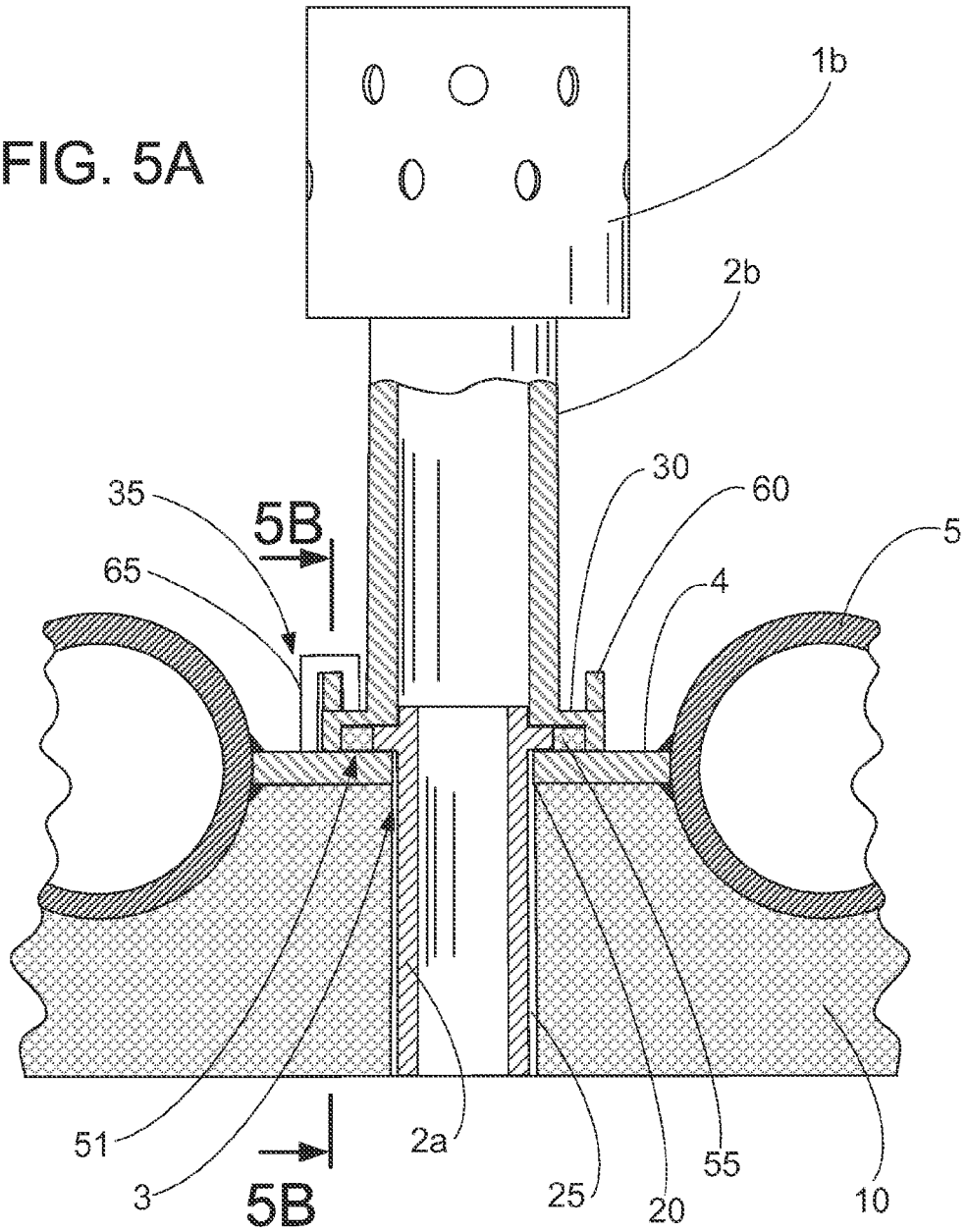
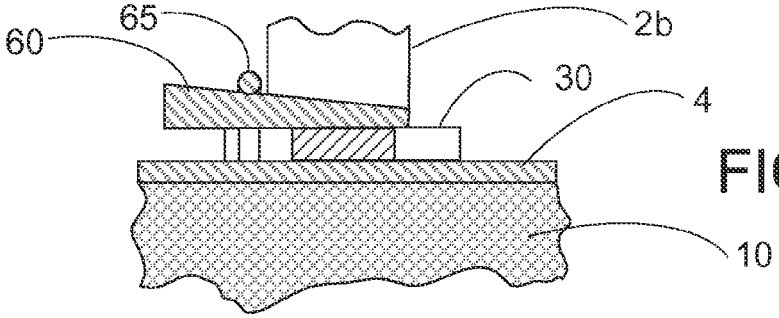
FIG. 5B

FLUIDIZING NOZZLE OR BUBBLE CAP ASSEMBLY FOR AIR DISTRIBUTION GRID

FIELD AND BACKGROUND OF INVENTION

The present invention relates generally to fluid bed boilers, particularly improved fluidizing nozzle or bubble cap assemblies for air distribution grids in fluid bed boilers.

An air distribution grid is an important feature of a fluid bed boiler. Its purpose is to achieve a uniform air distribution across the bed plan area to fluidize the bed material in the furnace and to prevent backsifting of the bed material into the windbox. The most typical air distribution grid design is an array of bubble cap assemblies attached to a water-cooled membrane panel. Designs of bubble cap assemblies vary widely; two examples are shown in FIG. 1 and FIG. 2. A bubble cap assembly comprises bubble cap 1 and stem 2 that connects the cap 1 to an opening 3 in membrane 4 which is welded to water-cooled tubes 5.

During a start-up, if the boiler uses in-duct start-up burners, the air distribution grid is subjected to hot gases with a temperature that can exceed 1600° F. The bubble cap assemblies (typically made of stainless steel) have essentially the same temperature as these gases. Membrane 4, welded to tubes 5 and protected from direct contact with the hot gases by refractory 10 in the design shown in FIG. 2, would have a temperature close to the saturation water temperature in tubes 5, i.e. somewhere from 500° F. to 650° F., depending on the drum pressure. Membrane 4 is typically made of carbon steel. Welding stems 2, typically made of stainless steel, to the carbon steel membrane 4 creates dissimilar metal welds where the material with a higher thermal expansion coefficient (stainless steel) is at a much higher temperature than the material with a lower thermal expansion coefficient (carbon steel) thus resulting in high thermal stresses and a corresponding potential for cracking.

In order to avoid the weld cracking, the design shown in FIG. 2 features tack welding 15 of stem 2 to membrane 4, allowing their independent thermal expansions. Accommodating these expansions during start-up requires a gap 20 between the outside of the stem and the inside of the opening in the membrane 4. The stems' expansion at start-up and contraction at normal operation (when the stem temperature is somewhere from 300° F. to 500° F., depending on the temperature of the air flow through the stems at normal operation) results in a gap 25 between stem 2 and refractory 10. Therefore, the design shown in FIG. 2 is prone to air leakage through these gaps, with the leakage air bypassing the bubble caps 1. Lowering air flow through the bubble caps 1 leads to lowering the pressure drop across the bubble caps 1; this is conducive to bed material backsifting through the bubble caps 1 into the windbox. The backsifting can also result in plugging and erosion of the bubble caps 1.

Thus, there is a need for a system which avoids weld cracking. A system not prone to air leakage is also needed, so as to avoid the resultant lowering of pressure drop across the bubble caps, and reduce the potential for bed material backsifting as well as plugging and erosion of the bubble caps.

SUMMARY OF INVENTION

The present invention reduces or eliminates backsifting of bed material through the bubble caps, as well as their plugging and erosion, by creating an air-tight connection between the bubble cap and the membrane while allowing their independent thermal expansions.

Accordingly, one aspect of the present invention is drawn to a system for improved air distribution in fluid bed boilers, namely a bubble cap assembly for an air distribution grid, comprising: a stem having a top region and a bottom region; a bubble cap connected to the top region of the stem; a membrane having an opening, the bottom region of the stem communicating with the opening; a flange connected to the bottom region of the stem; at least one clamp for pressing the flange against the membrane; and a gasket squeezed between the flange and the membrane by the clamp to provide an air-tight connection between the flange and the membrane.

Another aspect of the invention is drawn to a bubble cap assembly for an air distribution grid, comprising: a bifurcated stem having two top regions and a bottom region; a plurality of bubble caps, each bubble cap connected to a top region of the stem; a membrane having an opening, the bottom region of the stem communicating with the opening; a flange connected to the bottom region of the stem; at least one clamp for pressing the flange against the membrane; and a gasket squeezed between the flange and the membrane by the clamp to provide an air-tight connection between the flange and the membrane.

In some embodiments of the invention, the flange includes a recess, adapted to prevent the gasket from protruding from under the flange. A portion adjacent the recess also prevents the gasket from protruding to an inside area and potentially blocking the opening. The gasket provides an air-tight connection between the flange and the membrane.

The various features of novelty which characterize the invention are pointed out with particularity in the claims annexed to and forming part of this disclosure. For a better understanding of the present invention, and the operating advantages attained by its use, reference is made to the accompanying drawings and descriptive matter, forming a part of this disclosure, in which a preferred embodiment of the invention is illustrated.

BRIEF DESCRIPTION OF THE DRAWINGS

In the accompanying drawings, forming a part of this specification, and in which like reference numbers are used to refer to the same or functionally similar elements:

FIG. 5A is a side elevation view showing the clamp feature, as a wedge;

FIG. 5B is view of the clamp feature along line 5B-5B of FIG. 5A;

DESCRIPTION OF THE PREFERRED EMBODIMENTS

Figure 3:
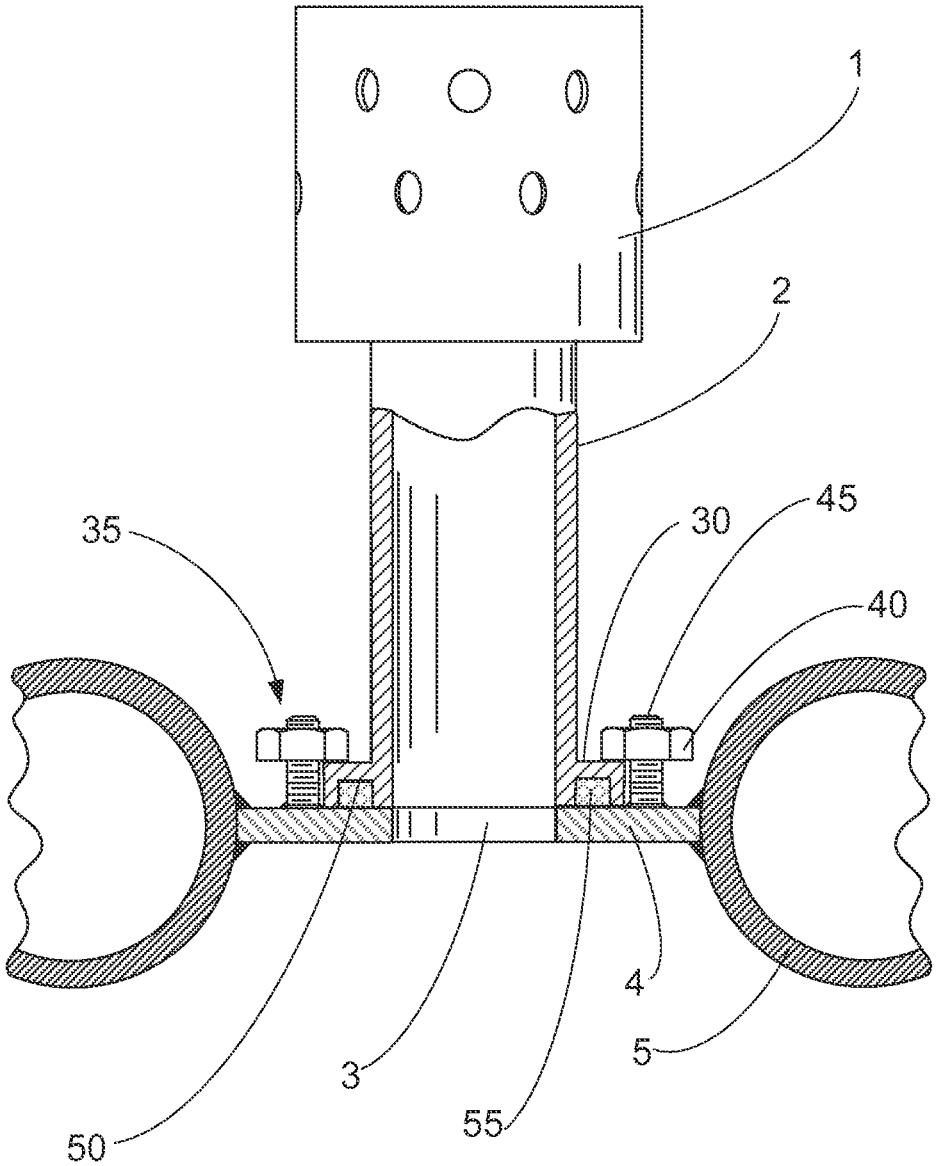
FIG. 3 is a side elevation view showing the basic elements of the present invention.

With reference to FIG. 3, one embodiment of the invention is shown therein, in which a bubble cap 1 is connected to a top region of stem 2. A bottom region of stem 2 is connected to opening 3 in membrane 4. Flange 30 is located at the bottom region of stem 2. Flange 30 is pressed against membrane 4 by clamps 35. In the embodiment shown in FIG. 3, the clamps 35 are made as nuts 40 screwed onto threaded studs 45 welded to membrane 4. In this embodiment, flange 30 features a recess 50 that keeps a gasket 55 from protruding from under flange 30. Gasket 55 is squeezed between flange 30 and membrane 4 providing an air-tight connection between them. A portion adjacent the recess 50 also prevents the gasket 55 from protruding to an inside area and potentially blocking opening 3.

Figure 1:
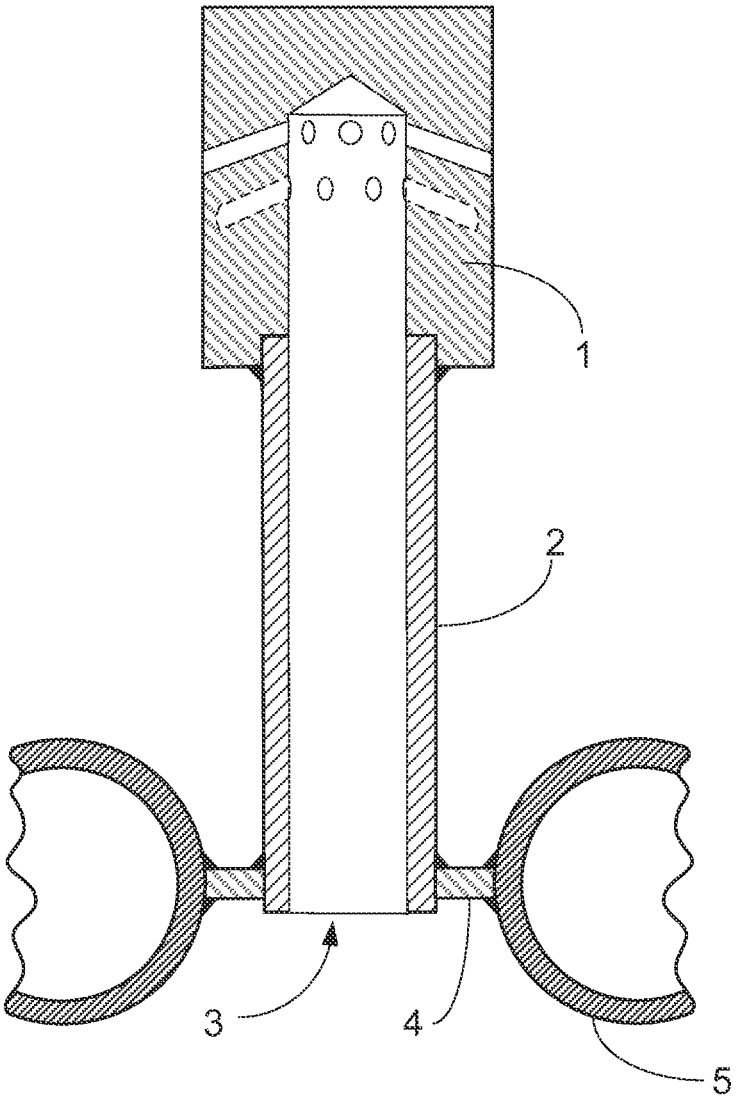
FIG. 1 (PRIOR ART)
FIG. 1 is a side elevation view of a prior art air distribution grid.
Figure 2:
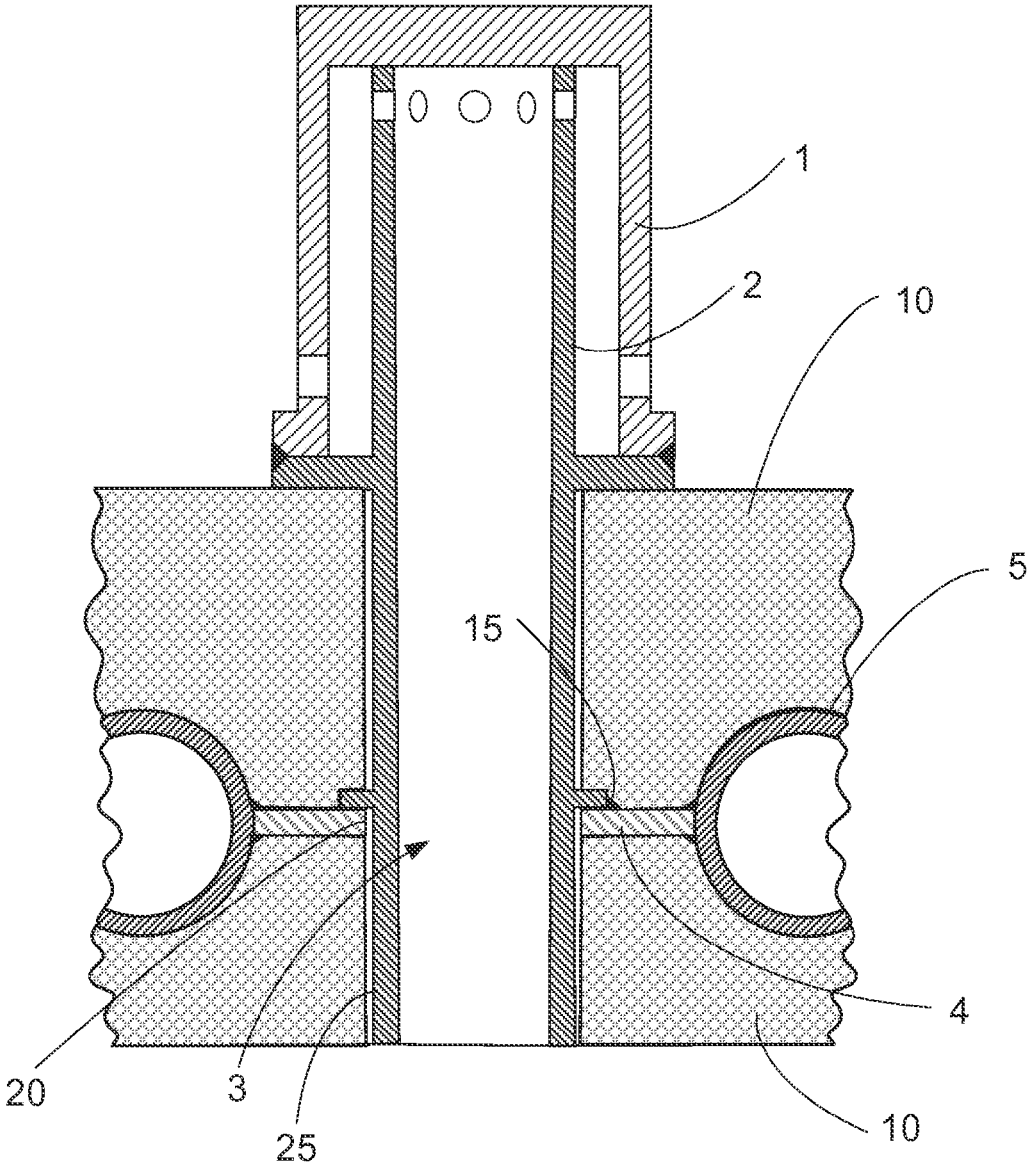
FIG. 2 (PRIOR ART)
FIG. 2 is a side elevation view of another prior art air distribution grid.
Figure 4:
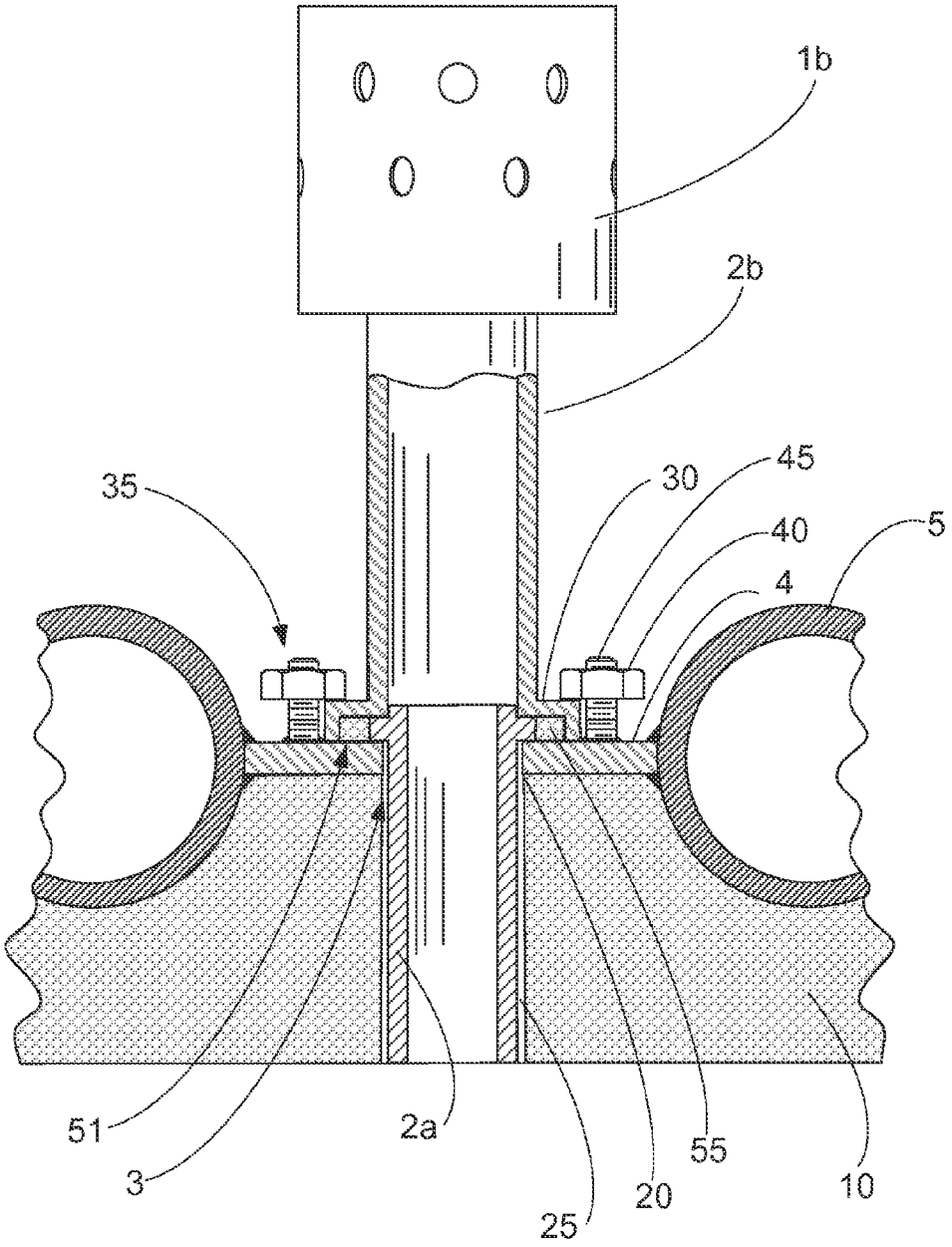
FIG. 4 is a side elevation view showing an embodiment of the present invention in which stem 2*a* of FIG. 4 is cut just above membrane 4.

FIG. 4 shows another embodiment that can be used when retrofitting the design shown in FIG. 2 for eliminating air leakage around the bubble caps. Stem 2 (of the retrofitted design per FIG. 2) is cut just above membrane 4. New bubble cap 1*b* with stem 2*b* is installed. Stem 2*b* has a flange 30 with recess 51 that keeps gasket 55 from protruding to the outside of flange 30. The remaining piece 2*a* of the old stem 2 keeps gasket 55 from protruding to the inside of flange 30.

With reference to FIGS. 5A and 5B, an embodiment is shown in which a clamp 35 is made as a wedge 60 pressed between flange 30 and hook 65 welded to membrane 4. While wedge 60 is shown as being tapered, it may alternatively be provided without any taper.

Figure 6A:
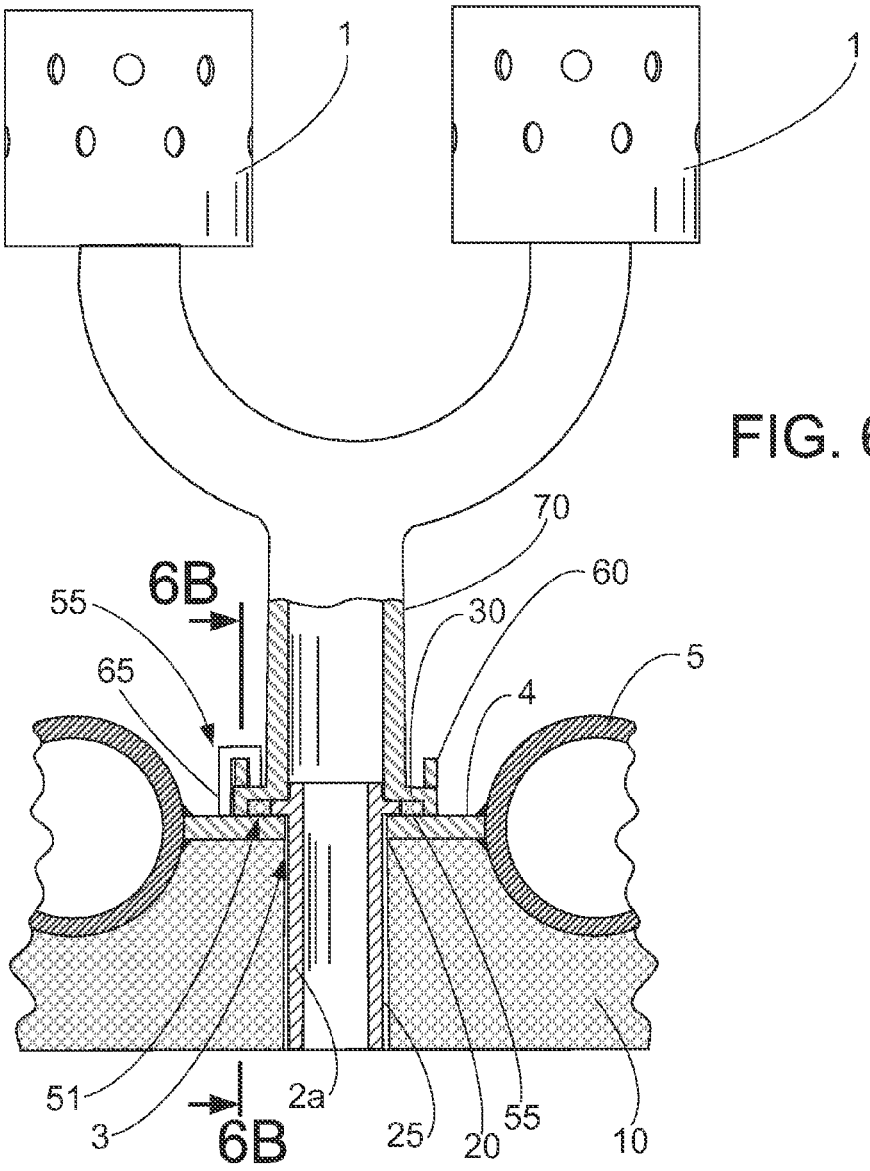
FIG. 6A is a side elevation view showing a bifurcated stem embodiment.
Figure 6B:
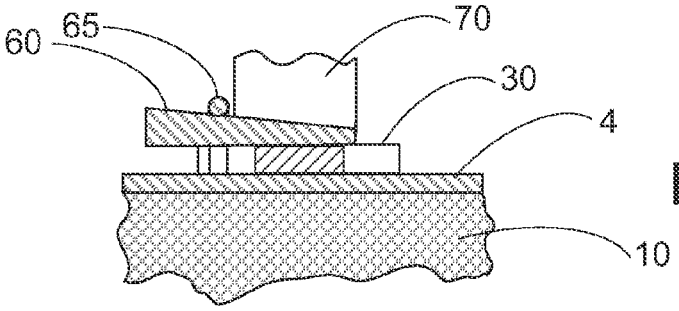
FIG. 6B is view of the clamp feature along line 6B-6B of FIG. 6A.

FIGS. 6A and 6B show an embodiment of the invention in which a bubble cap assembly comprises stem 70 with a bifurcated upper end and two bubble caps 1 (one on each top of the bifurcate). The lower end of stem 70 features flange 30 and is affixed to membrane 4 as described for the other embodiments.

Figure 7:
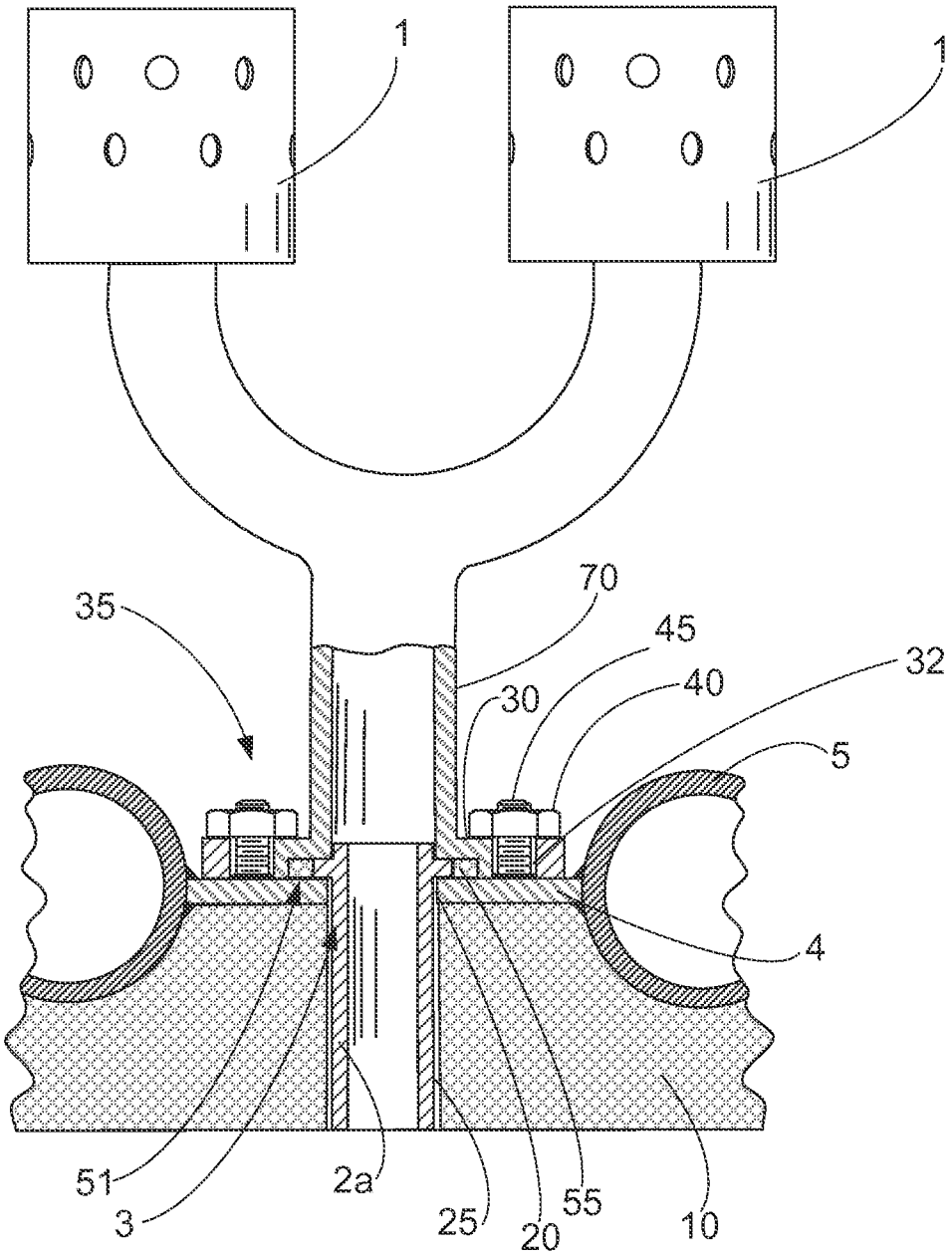
FIG. 7 is a side elevation view of the invention illustrating the relative orientations of the flange having apertures, threaded studs, and nuts for pressing the flange against the membrane.

In another embodiment, shown in FIG. 7, flange 30 has apertures 32 that accommodate threaded studs 45. Nuts 40 screwed onto studs 45 press flange 30 to membrane 4.

Figure 8:
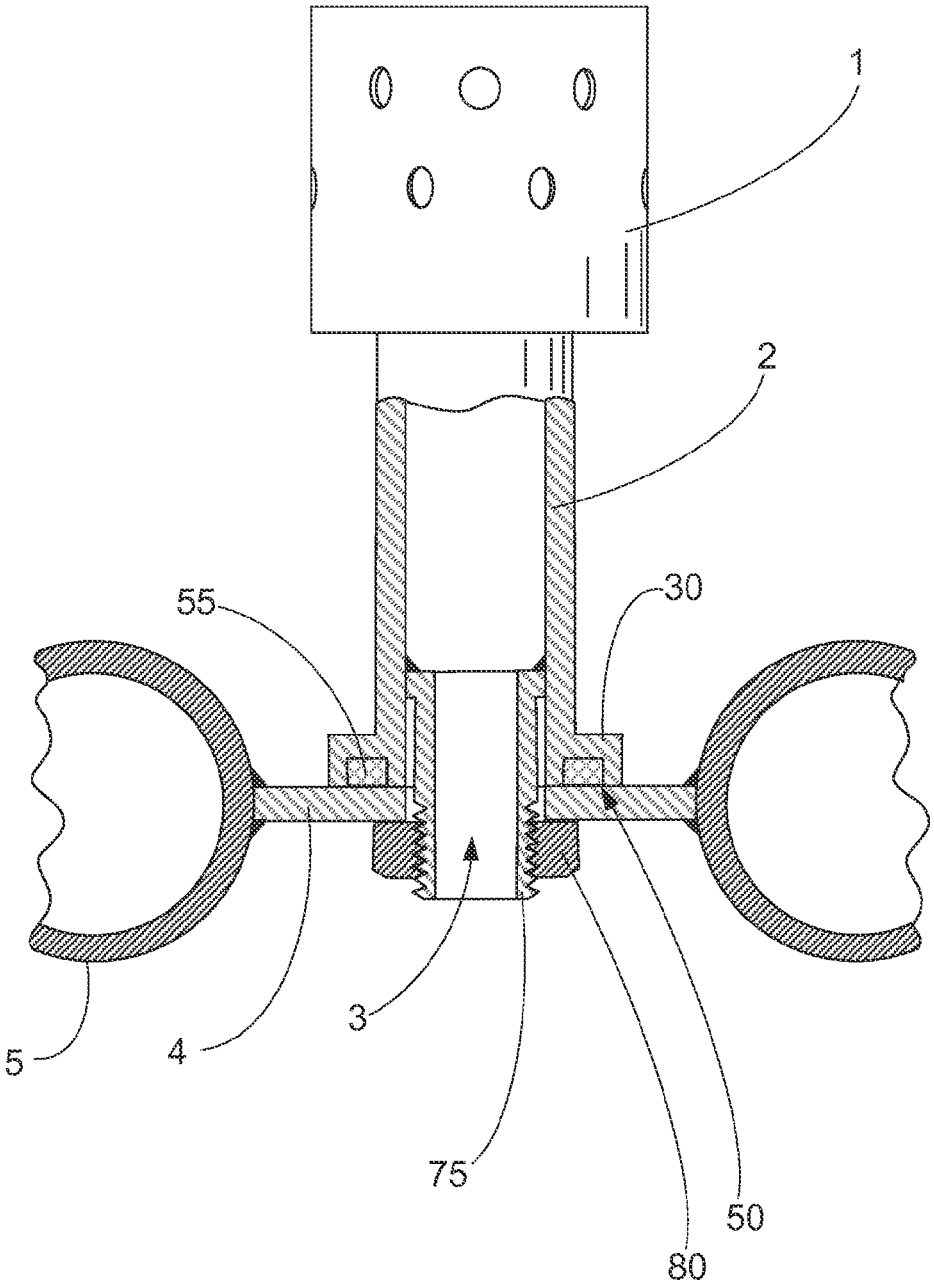
FIG. 8 is a side elevation view of the invention illustrating use of a threaded extension below the flange which protrudes through the opening in the membrane, secured by a nut threaded onto the extension from beneath the membrane to press the assembly against the membrane.

FIG. 8 shows an embodiment wherein flange 30 is pressed against membrane 4 by nut 80 screwed, from beneath the membrane 4, onto a threaded pipe or extension portion 75. Portion 75 may be either welded to stem 2 or alternatively provided as a threaded extension portion of stem 2 and protrudes through opening 3 in membrane 4.

Figure 9:
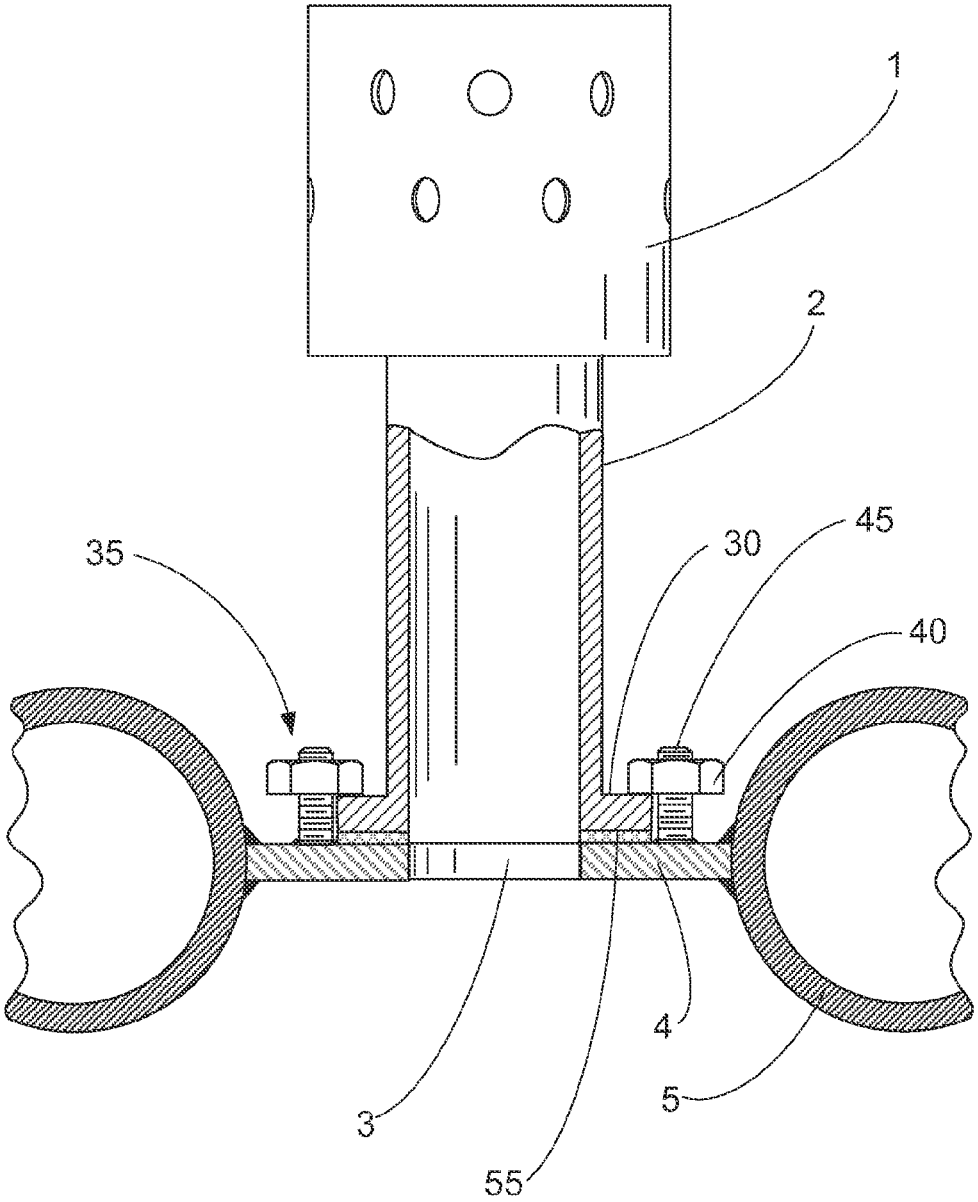
FIG. 9 is a side elevation view of another embodiment of the invention illustrating a flange in which no recess is provided.

FIG. 9 shows an embodiment wherein the flange 30 is not provided with a recess for the gasket 55.

Among the many advantages provided by the present invention, it should be noted that a combination of thickness and width of membrane 4 allows maintaining its temperature during a start-up within acceptable limits without refractory protection.

While specific embodiments and/or details of the invention have been shown and described above to illustrate the application of the principles of the invention, it is understood that this invention may be embodied as more fully described in the claims, or as otherwise known by those skilled in the art, including any and all equivalents, without departing from such principles.

We claim:

1. A bubble cap assembly for an air distribution grid, comprising:
- a stem having a top region and a bottom region;
- a bubble cap connected to the top region of the stem;
- a membrane having an opening, the bottom region of the stem communicating with the opening;
- a flange connected to the bottom region of the stem;
- at least one clamp for pressing the flange against the membrane, wherein the at least one clamp comprises a hook welded to the membrane and a wedge pressed between the flange and the hook; and
- a gasket squeezed between the flange and the membrane by the clamp to provide an air-tight connection between the flange and the membrane.

2. The bubble cap assembly of claim 1, comprising a recess provided in the flange for preventing the gasket from protruding from under the flange.

3. The bubble cap assembly of claim 2, comprising a portion adjacent the recess to keep the gasket from protruding to an inside area and potentially blocking the opening.

4. The bubble cap assembly of claim 1, wherein the flange is pressed against the membrane by a plurality of clamps.

5. A bubble cap assembly for an air distribution grid, comprising:
- a bifurcated stem having two top regions and a bottom region;
- a plurality of bubble caps, each bubble cap connected to a top region of the stem;
- a membrane having an opening, the bottom region of the stem communicating with the opening;
- a flange connected to the bottom region of the stem;
- at least one clamp for pressing the flange against the membrane, wherein the at least one clamp comprises a hook welded to the membrane and a wedge pressed between the flange and the hook; and
- a gasket squeezed between the flange and the membrane by the clamp to provide an air-tight connection between the flange and the membrane.

6. The bubble cap assembly of claim 5, comprising a recess provided in the flange for preventing the gasket from protruding from under the flange.

7. The bubble cap assembly of claim 6, comprising a portion adjacent the recess to keep the gasket from protruding to an inside area and potentially blocking the opening.

8. The bubble cap assembly of claim 5, wherein the flange is pressed against the membrane by a plurality of clamps.

* * * * *